US009278556B2

(12) United States Patent
Yoshizawa

(10) Patent No.: US 9,278,556 B2
(45) Date of Patent: Mar. 8, 2016

(54) PRINTER WITH CUTTING FUNCTION, AND METHOD FOR CUTTING AND PRINTING

(71) Applicant: Roland DG Corporation, Hamamatsu-shi, Shizuoka (JP)

(72) Inventor: Fumiyoshi Yoshizawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 14/336,490

(22) Filed: Jul. 21, 2014

(65) Prior Publication Data

US 2015/0022579 A1 Jan. 22, 2015

(30) Foreign Application Priority Data

Jul. 22, 2013 (JP) ..... 2013-152083

(51) Int. Cl.
*B41J 11/46* (2006.01)
*B41J 11/66* (2006.01)
*B41J 11/70* (2006.01)

(52) U.S. Cl.
CPC ..... *B41J 11/663* (2013.01); *B41J 11/706* (2013.01)

(58) Field of Classification Search
CPC ..... B41J 11/66; B41J 11/663; B41J 11/666; B41J 11/68; B41J 11/70; B41J 11/706
USPC ..... 347/16
See application file for complete search history.

(56) References Cited

U.S. PATENT DOCUMENTS

2006/0269311 A1* 11/2006 Yamauchi et al. ..... 399/82
2012/0148326 A1* 6/2012 Ipponyari et al. ..... 400/621
2012/0194597 A1* 8/2012 Okamoto et al. ..... 347/16

FOREIGN PATENT DOCUMENTS

JP 2001-233538 A 8/2001
JP 2012-225735 A 11/2012

OTHER PUBLICATIONS

Official Communication issued in corresponding European Patent Application No. 14177977.7 mailed on Feb. 4, 2015.

* cited by examiner

*Primary Examiner* — Geoffrey Mruk
*Assistant Examiner* — Scott A Richmond
(74) *Attorney, Agent, or Firm* — Keating and Bennett, LLP

(57) ABSTRACT

A printer with a cutting function includes a cutting mechanism configured to cut a medium, a sensor configured to detect a cut portion of the medium, a printing mechanism configured to perform printing on the medium, and a control device configured and programmed to control the cutting mechanism and the printing mechanism.

7 Claims, 4 Drawing Sheets

PRINTER WITH CUTTING FUNCTION, AND METHOD FOR CUTTING AND PRINTING

The present application claims priority based on the Japanese patent application No. 2013-152083 filed on Jul. 22, 2013, the entirety of which is hereby incorporated by reference.

BACKGROUND OF THE INVENTION

1. Field of the Invention

The present invention relates to a printer with a cutting function, and a method for cutting and printing.

2. Description of the Related Art

In recent years, various types of printers such as an inkjet printer are configured to perform high-resolution printing in order to provide high-quality printing. Also, a printer having a cutting function in addition to a printing function has been proposed.

A printer having a cutting function is provided with an ink head and a cutting head. The ink head achieves an image creation function of creating an image on a medium by performing printing on the medium on the basis of image data. The cutting head achieves a cutting function of cutting the medium on the basis of cutting data.

A position at which a medium is cut out in a printer with a cutting function is determined, for example, in the manner described below.

First, an ink head prints a crop mark image at a prescribed position of a medium, for example, a position near the four corners of a printed image after performing printing on the medium on the basis of image data, and thereafter, the cutting head performs positioning for cutting on the basis of cutting data with reference to the crop mark image.

In a printer with a cutting function, there has been a problem that if a medium is cut before the ink ejected on the medium is dried, the ink rubbed by a cutting head bleeds on a printed image.

Therefore, cutting is performed after ink is sufficiently dried in order to solve such a problem. However, such a process needs time to sufficiently dry the ink before cutting, and thus has generated another problem that working hours are increased.

Further, since a medium is exposed to heat while the ink is dried, in a case where a medium susceptible to heat is used, the medium is easily twisted by heat when extending a period for drying. Thus, there has been a new problem that the above process, when a medium susceptible to heat is used, may shift the position of a printed crop mark image, making it difficult to perform high-accuracy alignment for cutting.

SUMMARY OF THE INVENTION

Preferable aspects of the present invention provide a printer with a cutting function and a method for printing and cutting that significantly reduce or prevent bleeding on a printed image and provides accurate cutting.

A printer with a cutting function according to a preferable aspects of the present invention includes a cutting mechanism configured to cut a medium; a sensor configured to detect a cut portion of the medium; a printing mechanism configured to perform printing on the medium; and a control device configured and programmed to control the cutting mechanism and the printing mechanism. The control device includes a cutting control unit configured and programmed to receive cutting data and control the cutting mechanism to cut the medium on the basis of the cutting data; a crop mark creation unit configured and programmed to control the cutting mechanism to cut a portion in the medium other than the portion to be cut on the basis of the cutting data in order to create a crop mark on the medium; a printing reference position acquisition unit configured to acquire a printing reference position on the basis of the detection of the crop mark by the sensor; and a printing control unit configured and programmed to control the printing mechanism to perform printing on the medium on the basis of input image data using the printing reference position acquired by the printing reference position acquisition unit.

According to a preferable aspect of the present invention, the crop mark includes one or more holes which are formed by cutting out a portion of the medium. The crop mark may include first and second holes located on both sides of a portion in the medium to be cut on the basis of the cutting data. The crop mark may include holes respectively located on the upper left, lower left, lower right and upper right of the portion in the medium to be cut on the basis of the cutting data.

According to another preferable aspect of the present invention, the sensor is configured to detect at least one of a difference in level, color, gloss, and reflectance.

According to another preferable aspect of the present invention, a guide rail is provided. The cutting mechanism includes a cutting head which engages with the guide rail and is movable along the guide rail. The printing mechanism includes an ink head which engages with the guide rail and is movable along the guide rail. The printer includes a coupling member configured to detachably couple the cutting head with the ink head.

According to another preferable aspect of the present invention, an additional sensor is provided to detect a printed portion in the medium. The control device includes an additional printing control unit configured and programmed to control the printing mechanism to perform printing on the medium on the basis of input image data; a crop mark image creation unit configured and programmed to control the printing mechanism to print a crop mark image on the medium; a cutting reference position acquisition unit configured to acquire a cutting reference position on the basis of the detection of the crop mark image by the additional sensor; and an additional cutting control unit configured and programmed to control the cutting mechanism to cut the medium on the basis of input cutting data using the cutting reference position acquired by the cutting reference position acquisition unit.

Another preferable aspect of the present invention pertains to a method for performing cutting and printing on a medium using a printer with a cutting function or a set of cutting device and printer, the method includes a step of cutting the medium on the basis of input cutting data; a step of creating a crop mark on the medium by cutting a portion in the medium other than the portion to be cut on the basis of the cutting data; a step of detecting the crop mark; a step of acquiring a reference position for printing on the basis of the detection of the crop mark; and a step of printing on the medium on the basis of input image data using the acquired reference position for printing.

According to a preferable aspect of the present invention, the step of creating the crop mark includes a step of cutting out a portion of the medium.

According to another preferable aspect of the present invention, the step of detecting the crop mark includes a step of detecting at least one of a difference in level, color, gloss, and reflectance.

According to another preferable aspect of the present invention, a step of designating either a first method for performing printing after cutting or a second method for performing cutting after printing is included. When the first method is designated, each of the above-described steps is performed. When the second method is designated, a step of performing printing on the medium on the basis of input image data; a step of printing a crop mark image on the medium; a step of detecting the crop mark image; a step of acquiring a reference position for cutting on the basis of the detection of the crop mark image; and a step of cutting the medium on the basis of input cutting data using the acquired reference position for cutting, are performed.

According to various preferable aspects of the present invention, it is possible to provide a printer with a cutting function, and a method for cutting and printing, which significantly reduce or prevent bleeding on a printed image and providing accurate cutting.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, example preferred embodiments according to the present invention are described with reference to the attached drawings.

Figure 1:
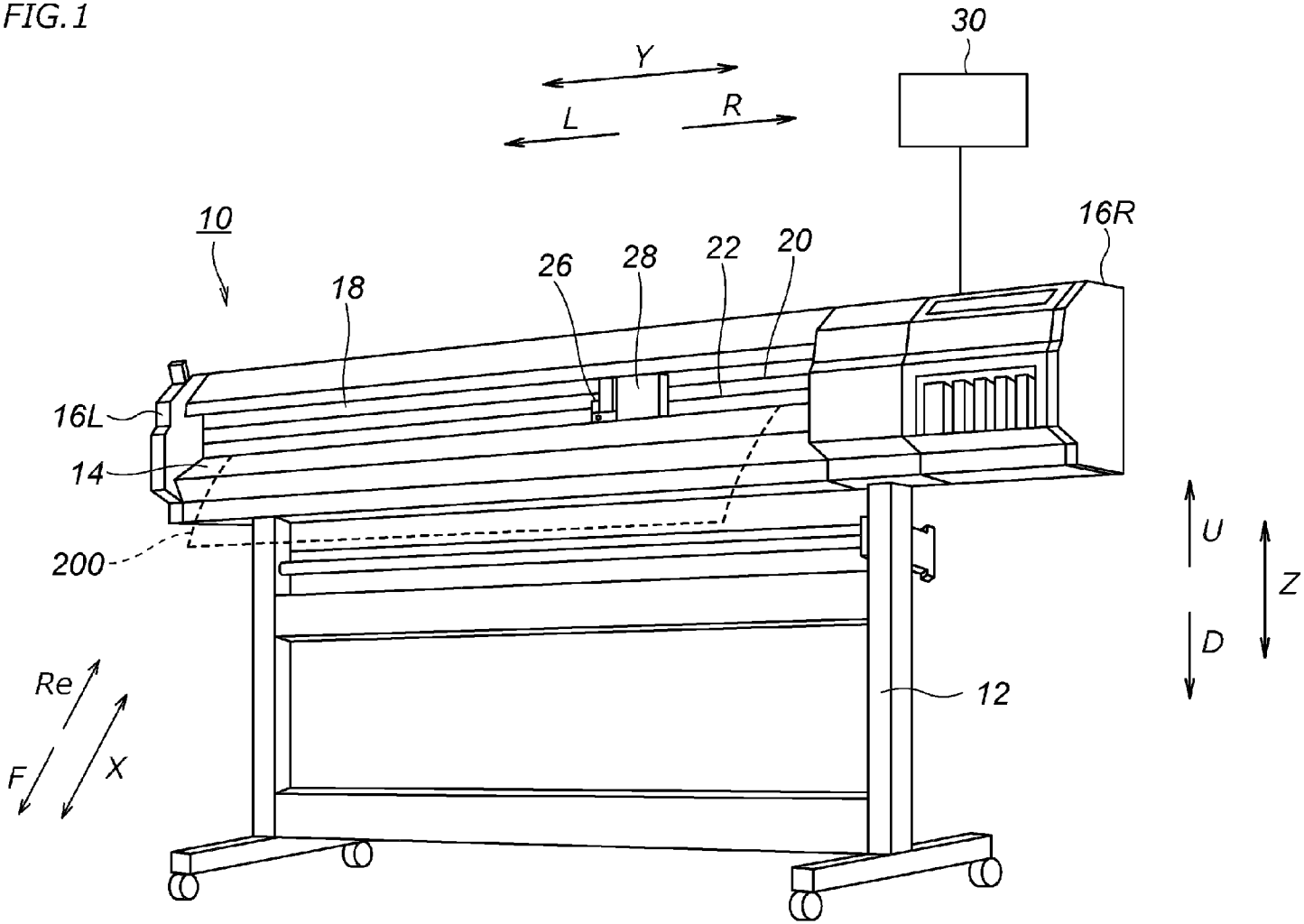
FIG. 1 is a perspective view illustrating an ink jet printer equipped with a cutting function.
Figure 2:
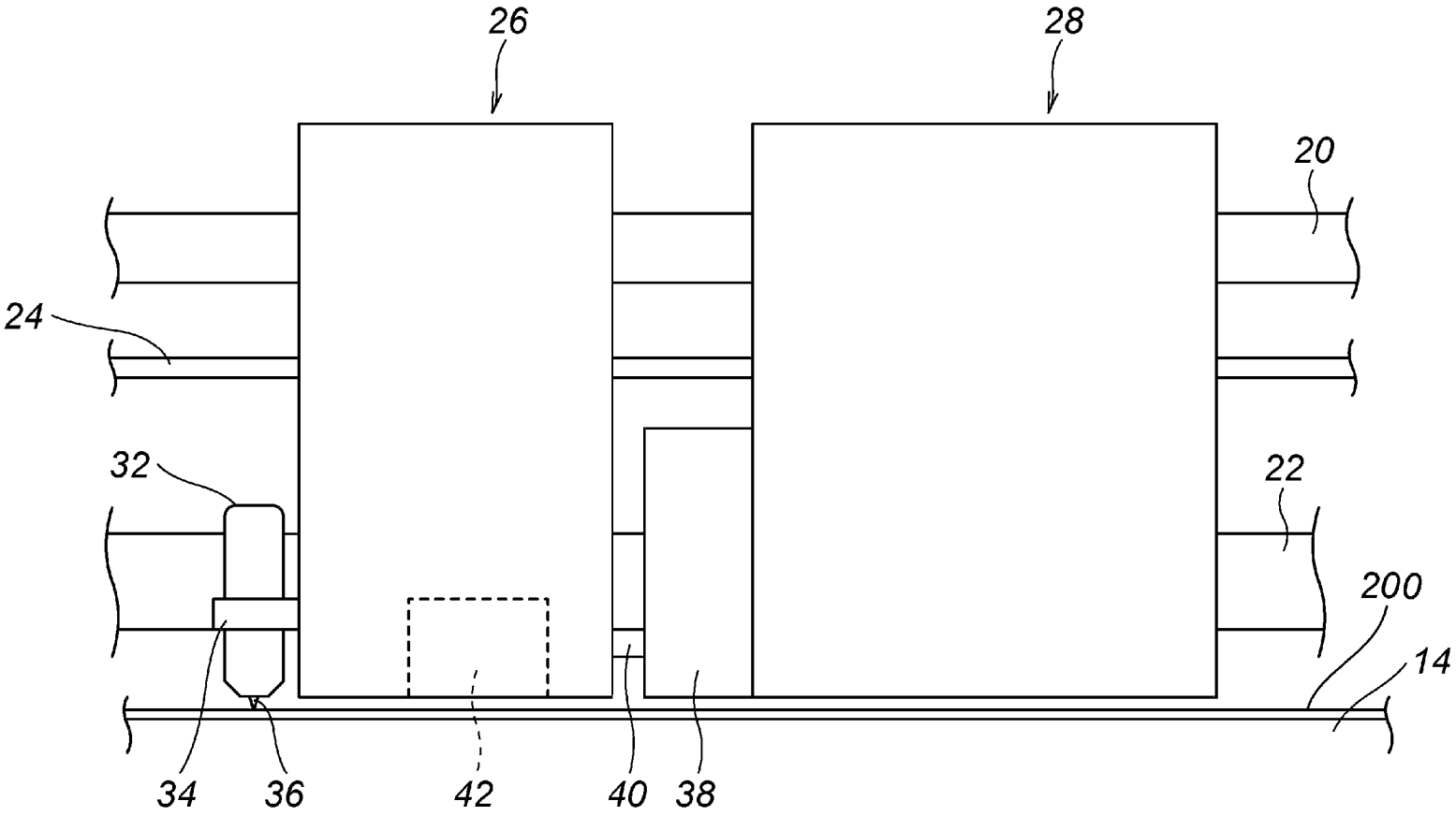
FIG. 2 is an enlarged view illustrating a main portion of the printer.

FIG. 1 shows a schematic configuration of an ink jet printer 10 equipped with a cutting function. FIG. 2 shows a schematic configuration of the main portion of the ink jet printer 10.

The ink jet printer 10 is provided with a paper feed device (not shown) configured to feed recording paper 200 that is an example of a medium in the longitudinal direction of the recording paper 200. The paper feed device is configured to allow the recording paper 200 to be fed onto a base member 14. Hereinafter, the width direction and the longitudinal direction of the recording paper 200 are respectively referred to as "a main scanning direction" and "a sub-scanning direction." Here, the main scanning direction and the sub-scanning direction are perpendicular or substantially perpendicular to each other. Symbols Y, X in FIG. 1 respectively represent the main scanning direction and the sub-scanning direction. A symbol Z represents a vertical direction. Symbols R, L, F, Re, U, and D respectively represent right, left, front, rear, up, and down.

The ink jet printer 10 includes a pedestal member 12, a base member 14, lateral members 16L, 16R, a central wall 18, a guide rail 20, a guide rail 22, a drive belt 24 (see FIG. 2), a cutting head 26, and an ink head 28. The base member 14 is supported by the pedestal member 12 and extends in the main scanning direction. The lateral members 16L, 16R are respectively arranged on the left end and the right end of the base member 14, and are perpendicular or substantially perpendicular to the base member 14. The central wall 18 connects the left lateral member 16L with the right lateral member 16R. The guide rail 20 is attached to the wall surface of the central wall 18 and extends in the main scanning direction. The guide rail 22 is parallel or substantially parallel to the guide rail 20. The drive belt 24 extends in the main scanning direction along the wall surface of the central wall 18. The cutting head 26 is fixed to the drive belt 24. The cutting head 26 slidably engages with the guide rails 20, 22, and faces the recording paper 200 on the base member 14. The ink head 28 also slidably engages with the guide rails 20, 22, and faces the recording paper 200 on the base member 14. The cutting head 26 and the ink head 28 are configured movably along the guide rails 20, 22.

The entire operation of the ink jet printer 10 is controlled by a microcomputer 30. The microcomputer 30 is configured and programmed to control the cutting head 26 and the ink head 28. The microcomputer 30 preferably is a dedicated special purpose computer incorporated into the ink jet printer 10, or may preferably be a general purpose computer which is configured to communicate with the ink jet printer 10 through a wire or radio system.

As shown in FIG. 2, the cutting head 26 is a device configured to cut the recording paper 200 into a prescribed shape using a cutter 32. The cutting head 26 is provided with the cutter 32 supported by a holder 34. A cutter blade 36 is attached to the lower end of the cutter 32. Additionally, the cutting head 26 includes a sensor 42 arranged to detect a crop mark image described later.

The ink head 28 is configured to eject ink to print a desired image on the recording paper 200 with the ink. The ink head 28 includes a bottom surface opposite the recording paper 200, and an ink jet nozzle (not shown) is provided on the bottom surface. A sensor 38 configured to detect a crop mark, which is described later, is arranged on the ink head 28.

The sensors 38, 42 are configured to detect, for example, reflectance. The type of the sensors 38, 42 is not limited. The detailed description of the sensors 38, 42 is omitted since conventionally well-known various types of sensors preferably are used as the sensors 38, 42.

A coupling member 40 connects the cutting head 26 with the ink head 28. The coupling member 40 is configured to switch conditions between a connected condition and a non-connected condition between the cutting head 26 and the ink head 28. In other words, the coupling member 40 detachably connects the cutting head 26 with the ink head 28. Since a mechanism configured to detachably connect the cutting head 26 with the ink head 28 is conventionally well-known, the detailed description of the mechanism is omitted. For example, the coupling member 40 may involve a mechanism having a magnet.

The drive belt 24 is movably configured with a driving mechanism (not shown). The driving mechanism configured to move the drive belt 24 is not particularly limited. Various types of conventionally known mechanisms may preferably be used as a driving mechanism. For example, the driving mechanism is provided with a driving pulley and a driven pulley, and the drive belt 24 is wound around them so that the drive belt 24 may be moved by the rotation of the driving pulley. The driving mechanism is controlled by the microcomputer 30.

The cutting head 26 is fixed to the drive belt 24. As such, when the drive belt 24 moves, the cutting head 26 moves in the main scanning direction along the guide rails 20, 22. When the cutting head 26 and the ink head 28 are not connected by the coupling member 40, only the cutting head 26 moves in the main scanning direction along the guide rails 20, 22. On the other hand, when the cutting head 26 and the ink head 28 are connected by the coupling member 40, both the cutting head 26 and the ink head 28 move in the main scanning direction along the guide rails 20, 22. As described above, the cutting head 26 is fixed to the drive belt 24 while the ink head 28 preferably is not fixed to the drive belt 24 in this preferred embodiment. However, the ink head 28 may be fixed to the drive belt 24 while the cutting head 26 may not be fixed to the drive belt 24.

Next, a non-limiting example of a method for cutting and printing by the ink jet printer 100 is described.

First, cutting data for cutting the recording paper 200 into a prescribed shape and image data for printing a prescribed image onto the recording paper 200 are input to the microcomputer 30. Under this condition, when the start of printing and cutting is indicated, the printing and cutting commences.

Figure 3:
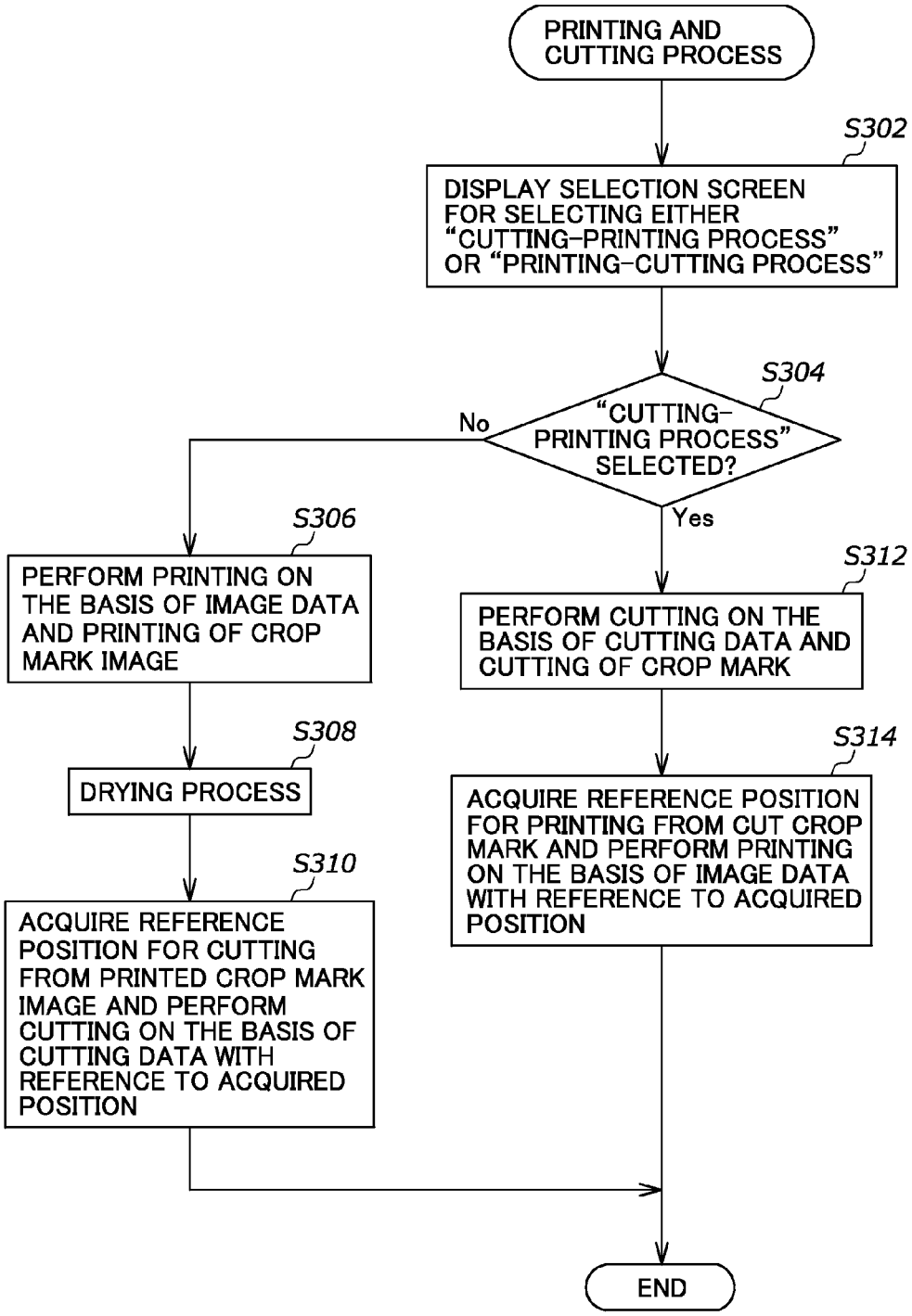
FIG. 3 is a flowchart illustrating the process of printing and cutting.

A flowchart shown in FIG. 3 discloses the process of printing and cutting. The microcomputer 30 performs the process. When performing the process of printing and cutting, first, the microcomputer 30 displays a selection screen on a display device (not shown) connected to the microcomputer 30, which allows a user to select either "cutting-printing process" where printing is performed after cutting, or "printing cutting process" where cutting is performed after printing (step S302). The user can select either one of the processes using the selection screen.

Next, the microcomputer determines whether or not "cutting-printing process" has been selected on the displayed selection screen (step S304).

When the microcomputer determines that "cutting-printing process" has not been selected in the determination process of the step S304 (that is, "printing-cutting process" has been selected on the selection screen), the print control unit of the microcomputer 30 prints a prescribed image on the recording paper 200 on the basis of image data (step S306).

When performing the process of step S306, the ink head prints the prescribed image on the recording paper 200 on the basis of the image data, while printing square-shaped crop mark images near the four corners of the prescribed image. The crop mark images serve as a mark used to acquire a reference position for cutting. The printing of the crop mark images is performed by a crop mark image creation unit of the microcomputer 30.

When the printing of the prescribed image based on the image data is completed, the ink ejected on the recording paper 200 is dried (step S308).

Subsequently to the drying process for ink, the sensor 42 detects the crop mark images printed in the process of step S306, and the reference position for cutting is acquired from the crop mark images by the cutting reference position acquisition unit of the microcomputer 30. Thereafter, cutting is performed on the basis of the cutting data using the acquired position as the reference position (step S310) and the process for printing and cutting is completed.

The technique of acquiring a reference position for cutting from crop mark images and performing cutting to create a prescribed shape at a prescribed position with reference to the acquired position is well-known, and thus the detailed description is omitted.

Meanwhile, the microcomputer 30 determines that "cutting-printing process" has been selected in the process of the step 304, the cutting control unit of the microcomputer 30 controls the cutting head 26 to cut the recording paper 200 into a prescribed shape on the basis of the cutting data (step S312).

Figure 4A:
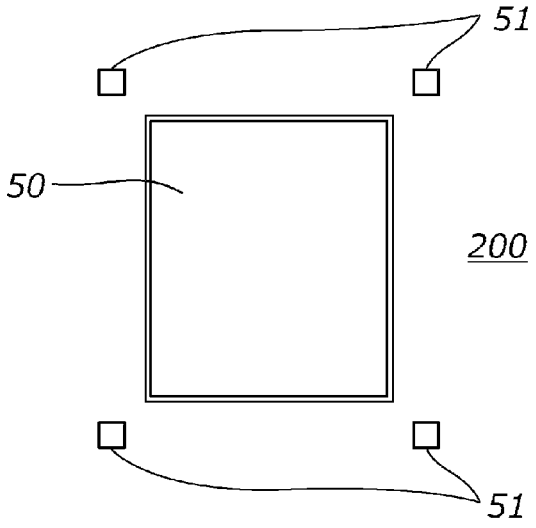
FIG. 4A is a view illustrating an example of a crop mark.

According to this preferred embodiment, the cutting control unit is configured and programmed to cut the recording paper 200 into a prescribed shape on the basis of the cutting data, while performing square-shaped cutting to create a crop mark near the four corners of the portion cut into the prescribed shape in the process of the step S312 (see FIG. 4A). The crop mark serves as a mark to acquire a reference position for printing. Here, "cut the recording paper into a prescribed shape" means that a portion of the recording paper 200 is cut off to create a piece of paper having a prescribed shape separated from the other portion of the recording paper 200. The cutting control unit of the microcomputer 30 is configured and programmed to cut the recording paper 200 on the basis of the input cutting data. In order to create the crop mark, a crop mark creation unit of the microcomputer 30 cuts a portion of the recording paper 200 other than the portion to be cut on the basis of the cutting data.

Subsequent to the cutting of the recording paper 200 into a prescribed shape based on the cutting data, the portion cut to create the crop mark is removed from the recording paper 200. In this preferred embodiment, an operator removes the cut portion. Instead, a device configured to automatically remove the cut portion may be provided. By removing the above described portions, four square-shaped holes are formed in the recording paper 200. That is, the four square-shaped holes are formed preferably on the upper left, lower left, lower right, and upper right of the portion cut from the recording paper 200 on the basis of the cutting data. In this preferred embodiment, the square-shaped cutout portions, that is, the four square-shaped holes create the crop mark. Additionally, an image is subsequently printed on the portion cut from the other portion of the recording paper 200 on the basis of the cutting data. For that purpose, the portion to be cut on the basis of the cutting data is not removed from the recording paper 200 at this moment.

Next, the sensor 38 detects the crop mark, and the printing reference position acquisition unit of the microcomputer 30 acquires a reference position for printing from the crop mark. Thereafter, the microcomputer 30 controls the ink head 28 to print the image data with reference to the acquired position (step 314). The print control unit of the microcomputer 30 controls the ink head to print the input image data on the recording paper 200 using the reference position for printing which is acquired by the printing reference position acquisition unit. Then, the printing and cutting process is completed.

Additionally, the technique of printing a prescribed image with reference to the position acquired from the crop mark preferably is the same as the technique of cutting the recording paper into a prescribed shape with reference to the position acquired from the printed crop mark images. The technique includes various types of well-known techniques. Therefore, the detailed description is omitted.

As described above, the ink jet printer 10 with the cutting function according to this preferred embodiment first performs the cutting process to cut the recording paper 200 into a prescribed shape, and then performs the printing process to print a prescribed image. When performing the cutting process, the crop mark is created by forming square-shaped cutouts near the four corners of the cut portion. Thereafter, the crop mark is detected by the sensor 38 and the reference position for printing is acquired from the detected crop mark so that printing is performed on the basis of the image data with reference to the acquired position.

According to the ink jet printer 10 of this preferred embodiment, when "cutting-printing process" is performed, cutting is performed prior to the printing of a prescribed image, and thus the problem that the ink rubbed by a cutting head bleeds on a printed image is eliminated. Further, the drying process for ink is no longer needed prior to the cutting process, and thus the working hours are significantly reduced. Additionally, since there is no need for a long-hour drying process for ink prior to the cutting process, even if a printing and cutting processes is applied to a medium susceptible to heat, the medium is prevented from being twisted, and thus cutting and printing can be accurately performed.

The above described preferred embodiment is only one example of various preferable aspects of the present invention. For example, preferred embodiments as shown in preferred embodiments 1 through 7 described below are also included in the present invention.

(1) In the above described preferred embodiment, when a printing and cutting process commences, a selection screen used to select either "cutting-printing process" or "printing-cutting process" is displayed, and a process selected by an operator is performed. However, the present invention is not limited to this preferred embodiment. When the printing and cutting process commences, the ink jet printer 10 may be configured to always perform a "cutting-printing process". In this case, the cutting head 26 does not need to be equipped with the sensor 42.

(2) In the above described preferred embodiment, although the ink jet printer 10 with a cutting function performs a "cutting-printing process", the present invention is definitely not limited to this preferred embodiment. The "cutting-printing process" may be performed by using a cutting device and a printing device that are separate from each other. The "cutting-printing process" may be performed by using a cutting device with no printing function, and a printing device with no cutting function. In this case, the cutting device may be equipped with the cutting head 26, and the printing device may be equipped with the ink head 28 and the sensor 38.

(3) In the above described preferred embodiment, although the ink jet printer 10 with a cutting function preferably performs a printing process by ink jet method by way of example, the present invention is definitely not limited to this preferred embodiment. The printing process may be performed by using various types of printing methods such as a laser system and a dot impact system, for example.

(4) In the above described preferred embodiment, although the sensor 38 is provided to detect reflectance, the present invention is definitely not limited to this preferred embodiment. The sensor 38 may include a sensor configured to detect a difference in level, a sensor configured to detect a color, or a sensor configured to detect gloss.

Figure 4B:
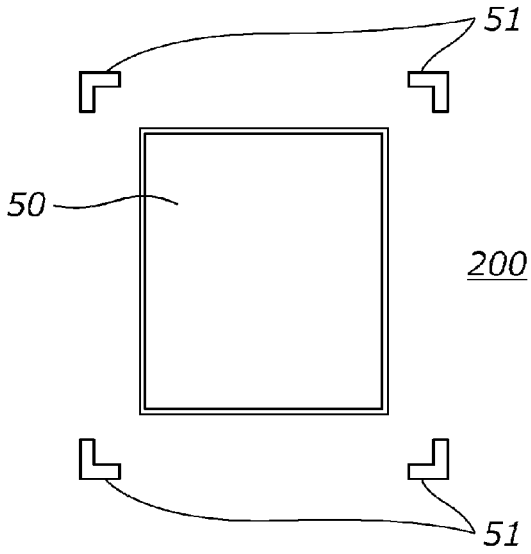
FIG. 4B is a view illustrating a variation of the crop mark.
Figure 4C:
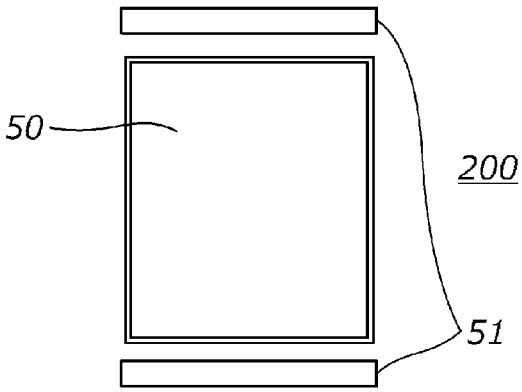
FIG. 4C is a view illustrating another variation of the crop mark.

(5) In the above described preferred embodiment, the "cutting-printing process" preferably creates the crop mark configured by four square-shaped holes 51 by performing cutting to provide square-shaped cutouts near the four corners of the portion 50 that is cut off on the basis of the cutting data as shown in FIG. 4A. The crop mark preferably includes four holes 51 located at upper left, lower left, lower right, and upper right of the portion 50. However, the present invention is definitely not limited to this preferred embodiment. For example, as shown in FIG. 4B, the crop mark may be created by cutting out L-shaped or substantially L-shaped portions near the four corners of the portion 50 that is cut off on the basis of the cutting data. Also, in this case, the crop mark preferably includes four holes 51 located at upper left, lower left, lower right, and upper right of the portion 50. Further, as shown in FIG. 4C, the crop mark may be created by cutting out linear portions with a prescribed width on both upper and lower sides of the portion 50 that is cut off on the basis of the cutting data. In this case, the crop mark includes first and second holes 51 located on both upper and lower sides of the portion 50. Additionally, the crop mark may include first and second holes located on both right and left sides of the portion 50.

(6) In the above described preferred embodiment, the process of the step S312 is performed such that the recording paper 200 preferably is cut into a prescribed shape on the basis of the cutting data, and thereafter, cutting is performed to create the crop mark. However, the present invention is definitely not limited to this preferred embodiment. That is, the process of the step S312 may be performed such that cutting is performed to create the crop mark, and thereafter, the recording paper 200 is cut into a prescribed shape on the basis of the cutting data.

(7) The above described preferred embodiment and the variations (1) through (6) discussed above may be combined each other as necessary.

Additionally, a "medium" used in the specification may include not only various types of recording media made of papers such as plain paper, but also media made of various types of materials such as resins including PCV, polyester and so forth, and other materials such as aluminum, iron, woods and so forth.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printer with a cutting function comprising:

a cutting mechanism configured to cut a medium;

a sensor configured to detect a cut portion of the medium;

a printing mechanism configured to perform printing on the medium; and a control device configured and programmed to control the cutting mechanism and the printing mechanism; wherein the control device includes:

a cutting control unit configured and programmed to receive cutting data and control the cutting mechanism to cut the medium based on the cutting data;

a crop mark creation unit configured and programmed to control the cutting mechanism to cut a portion in the medium other than the portion to be cut based on the cutting data in order to create a crop mark on the medium;

a printing reference position acquisition unit configured to acquire a printing reference position based on the detection of the crop mark by the sensor; and a printing control unit configured and programmed to control the printing mechanism to perform printing on the medium based on input image data using the printing reference position acquired by the printing reference position acquisition unit.

2. The printer with a cutting function according to claim 1, wherein the crop mark includes one or more holes which are formed by cutting out a portion of the medium.

3. The printer with a cutting function according to claim 2, wherein the crop mark includes first and second holes located on both sides of a portion in the medium to be cut based on the cutting data.

4. The printer with a cutting function according to claim 2, wherein the crop mark includes holes respectively located on upper left, lower left, lower right and upper right areas of the portion in the medium to be cut based on the cutting data.

5. The printer with a cutting function according to claim 1, wherein the sensor is configured to detect at least one of a difference in level, color, gloss, and reflectance.

6. The printer with a cutting function according to claim 1, further comprising a guide rail, wherein the cutting mechanism includes a cutting head configured to engage with the guide rail and to be movable along the guide rail;

the printing mechanism includes an ink head configured to engage with the guide rail and to be movable along the guide rail; and the printer includes a coupling member configured to detachably couple the cutting head with the ink head.

7. The printer with a cutting function according to claim 1, further comprising an additional sensor configured to detect the printed portion in the medium, wherein the control device includes:

an additional printing control unit configured and programmed to control the printing mechanism to perform printing on the medium based on input image data;

a crop mark image creation unit configured and programmed to control the printing mechanism to print a crop mark image on the medium;

a cutting reference position acquisition unit configured to acquire a cutting reference position based on the detection of the crop mark image by the additional sensor; and an additional cutting control unit configured and programmed to control the cutting mechanism to cut the medium based on input cutting data using the cutting reference position acquired by the cutting reference position acquisition unit.

* * * * *